US009994051B2

(12) United States Patent
Hoshi et al.

(10) Patent No.: US 9,994,051 B2
(45) Date of Patent: Jun. 12, 2018

(54) ROLL-UP PREVENTION DEVICE AND LABEL TIP SETTING METHOD FOR LINERLESS LABEL IN THERMAL PRINTER

(71) Applicant: SATO HOLDINGS KABUSHIKI KAISHA, Tokyo (JP)

(72) Inventors: Kazuyuki Hoshi, Saitama (JP); Keita Ohashi, Saitama (JP); Takumi Nakamori, Iwate (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/129,699

(22) PCT Filed: Dec. 25, 2014

(86) PCT No.: PCT/JP2014/084370
§ 371 (c)(1),
(2) Date: Sep. 27, 2016

(87) PCT Pub. No.: WO2015/151365
PCT Pub. Date: Oct. 8, 2015

(65) Prior Publication Data

US 2017/0173979 A1 Jun. 22, 2017

(30) Foreign Application Priority Data

Mar. 31, 2014 (JP) ..... 2014-072563

(51) Int. Cl.

| | |
|---|---|
| ***B41J 11/04*** | (2006.01) |
| ***B41J 2/32*** | (2006.01) |
| *B41J 15/04* | (2006.01) |
| *B65C 9/18* | (2006.01) |

(52) U.S. Cl.
CPC ..... *B41J 11/04* (2013.01); *B41J 2/32* (2013.01); *B41J 15/044* (2013.01); *B65C 9/18* (2013.01)

(58) Field of Classification Search
None
See application file for complete search history.

(56) References Cited

U.S. PATENT DOCUMENTS 5,779,370 A 7/1998 Schroeder et al.

FOREIGN PATENT DOCUMENTS

| | | | | |
|---|---|---|---|---|
| EP | 2305482 | A1 * | 4/2011 | ..... B41J 3/4075 |
| JP | 9-314948 | | 12/1997 | |
| JP | 2005-081730 | A | 3/2005 | |
| JP | 3636476 | B2 | 4/2005 | |
| JP | 2013-215899 | A | 10/2013 | |
| WO | WO 97/30921 | A1 | 8/1997 | |

OTHER PUBLICATIONS

Machine Translation of JP 09314948, Takeuchi, Sakae, "Label Involvement Preventing Device for Label Printer", Dec. 9, 1997, KK Sato, Paragraphs 0023-0034 and Figs. 4-5.*

* cited by examiner

*Primary Examiner* — Lisa M Solomon
(74) *Attorney, Agent, or Firm* — Foley & Lardner LLP

(57) ABSTRACT

In a roll-up prevention unit, an upstream roll-up prevention member guides a linerless label toward a platen roller. A downstream roll-up prevention member guides the linerless label away from the platen roller. Brackets have a roller engagement hole engaging with a roller shaft of the platen roller, and fixes the position of the roll-up prevention unit relative to the platen roller.

8 Claims, 9 Drawing Sheets

ROLL-UP PREVENTION DEVICE AND LABEL TIP SETTING METHOD FOR LINERLESS LABEL IN THERMAL PRINTER

TECHNICAL FIELD

The present invention relates to a roll-up prevention device and a label tip setting method for a linerless label in a thermal printer, and in particular to a roll-up prevention device and a label tip setting method for a linerless label in a thermal printer that can prevent the linerless label from being rolled up during the feeding of the linerless label in both forward and reverse directions.

BACKGROUND ART

Conventionally, linerless labels, which are belt-like label paper sheets, are used for the purpose of saving resources. A linerless label does not use a liner sheet (release liner) that is temporarily attached to an adhesive layer on the back surface side of a label base. Printers for such linerless labels (e.g., thermal printers) have also been developed. JP 3636476B discloses a printer for linerless labels.

FIG. 7 is a schematic side view of a thermal printer 1 as a comparative example. The thermal printer 1 includes a supply unit 3 for supplying a linerless label 2, a detection unit 4, a printing unit 5, and a cutting unit 6.

As apparent from an enlarged cross-sectional view of the linerless label 2 presented in FIG. 7, the linerless label 2 includes a belt-like label base 7, an adhesive layer 8 that is formed on a back surface of the label base 7, and a thermo-sensitive coloring agent layer 9 and a release agent layer 10 that are formed as a lower layer and an upper layer, respectively, on a front surface of the label base 7.

Therefore, when the linerless label 2 is set in a rolled state in the supply unit 3, the adhesive layer 8 and the release agent layer 10 are in contact with each other, and thus the linerless label 2 in the rolled state can be advanced in the form of a belt along a feeding path 11, from the upstream side toward the downstream side, without adhesion between the inner layer and the outer layer of the linerless label 2 in the rolled state. Guide rollers 12, 13 provided along the feeding path 11 can guide the linerless label 2.

Note that position detection marks (not shown) are printed in advance on the back surface of the label base 7 at a predetermined pitch.

The detection unit 4 includes a mark sensor 14, and detects the aforementioned position detection marks on the linerless label 2. In this way, the position of the linerless label 2 relative to the printing unit 5 and the cutting unit 6 can be detected.

The printing unit 5 includes a thermal head 15 and a platen roller 16, supplies and arranges the linerless label 2 to be nipped between the thermal head 15 and the platen roller 16, feeds the linerless label 2 through the rotation and driving of the platen roller 16, and supplies a heating element 15A of the thermal head 15 with printing data. In this way, predetermined printing can be performed on the front surface of the label base 7.

The cutting unit 6 includes a movable blade 17 and a fixed blade 18, and issues individual linerless label strips 2A by cutting off the linerless label 2 at a predetermined pitch. After the cutting unit 6 cuts off the linerless label 2, the linerless label 2 is fed in reverse to be on standby for the next printing. Specifically, a label tip portion 2B stands by while projecting toward the cutting unit 6 from the position of nip between the thermal head 15 and the platen roller 16.

Note that the linerless label 2 may be perforated (not shown) at a predetermined pitch. In this way, individual linerless label strips 2A can be issued by tearing off the printed linerless label 2 at the perforations without using any cutter.

In the thermal printer 1 configured in the above-described manner, components that come into contact with the adhesive layer 8 representing a back surface of the linerless label 2, such as components provided along the feeding path 11 (the guide roller 13, and if necessary, the guide roller 12) and the platen roller 16, are made of materials with releasing properties so as to secure their non-adhesive properties, or have been subjected to surface treatment so that their surfaces have releasing properties (non-adhesive properties). For example, the platen roller 16 is made of silicone rubber.

SUMMARY OF INVENTION

However, with continuous or long-term use of the thermal printer 1, non-adhesive properties of the platen roller 16 gradually decrease. As a result, the linerless label 2 easily sticks to and is easily rolled up by the platen roller 16.

Further, the linerless label 2 sticks to the platen roller 16 also when the operation of the thermal printer 1 has been stopped for a long period of time with the linerless label 2 nipped between the thermal head 15 and the platen roller 16.

FIG. 8 is an enlarged side view showing the state where the linerless label 2 has been rolled up by the platen roller 16 that has been moved in a forward direction, i.e., from the upstream side to the downstream side (forward feeding). As shown in FIG. 8, if the label tip portion 2B of the printed linerless label 2 has been rolled up as a result of sticking to the outer circumferential surface side of the platen roller 16 (an outer surface of the platen roller 16 at the downstream side) along with the forward rotation of the platen roller 16, there will be problems in the issuance and discharge of the linerless label 2.

It takes great effort to remove the linerless label 2 that has stuck to the platen roller 16. Even if the platen roller 16 is rotated in reverse, the linerless label 2 often remains stuck to the outer surface of the platen roller 16 at the upstream side.

FIG. 9 is an enlarged side view showing the state where the linerless label 2 has been rolled up by the platen roller 16 that has been moved in a reverse direction (this means reverse feeding from the downstream side to the upstream side, and is also referred to as backward feeding). After a printed leading end (not shown) of the linerless label is cut off by the cutting unit 6, the platen roller 16 is rotated in reverse so as to feed the subsequent linerless label 2 in reverse to a printing start position in the printing unit 5 and set the label tip portion 2B at the printing start position in the printing unit 5. As the supply unit 3 is not connected to a driving source and does not have the function of rewinding the linerless label 2, the linerless label 2 becomes slack in a section that is upstream relative to the platen roller 16. In a normal state, as indicated by a virtual line in FIG. 9, the slack linerless label 2 forms a gentle curve in a section that is upstream relative to the guide roller 13. On the other hand, when the adhesive layer 8 of the linerless label 2 has stuck to the platen roller 16, the platen roller 16 is rotated in reverse with the linerless label 2 stuck thereto, and the linerless label 2 is rolled up while being stuck to an outer circumferential surface of the platen roller 16 at the upstream side as indicated by a solid line in FIG. 9. This could possibly cause problems in the next printing and issuance. This phenomenon is notable when a backward feeding length is large.

When the linerless label 2 is perforated (not shown) at a predetermined pitch as mentioned earlier, the stress induced by the slack is concentrated on perforated portions, which have low stiffness. This could possibly cause bending and significant meandering of the linerless label 2, and further facilitate the roll-up.

A mechanism has been devised that prevents the platen roller 16 from rolling up the linerless label 2 by providing a release member (roll-up prevention member) in the vicinity of the platen roller 16. However, this requires precise designing of the short distance between the release member and the platen roller 16, as well as stable maintenance of the relative positional relationship with the platen roller 16 in long-term use of the thermal printer 1.

The present invention has been made in view of the above issues, and aims to provide a roll-up prevention device and a label tip setting method for a linerless label in a thermal printer that can prevent the linerless label from being rolled up during the feeding of the linerless label in both forward and reverse directions.

The focus of the following aspects of the present invention is to provide a roll-up prevention unit that can be integrated with a platen roller.

According to a first aspect, provided is a roll-up prevention device for a linerless label in a thermal printer configured to arrange the linerless label to be nipped between a thermal head and a platen roller, feed the linerless label from an upstream side toward a downstream side along a feeding path for the linerless label, and perform printing on the linerless label. The linerless label has a label base, an adhesive layer formed on a back surface of the label base, and a thermo-sensitive coloring agent layer and a release agent layer both formed on a front surface of the label base. The roll-up prevention device includes a roll-up prevention unit including a pair of left and right brackets, an upstream roll-up prevention member, and a downstream roll-up prevention member. The pair of left and right brackets is positioned at both left and right end sides of the platen roller, and the upstream roll-up prevention member and the downstream roll-up prevention member span between the brackets. The upstream roll-up prevention member is positioned upstream relative to the platen roller, and guides the linerless label toward the thermal head and the platen roller while being in contact with the adhesive layer representing a back surface of the linerless label. The downstream roll-up prevention member is positioned downstream relative to the platen roller, and guides the linerless label away from the platen roller while being in contact with the adhesive layer representing the back surface of the linerless label. At least one of the pair of left and right brackets has a roller engagement hole engaging with a roller shaft of the platen roller. At least one of the pair of left and right brackets fixes a position of the roll-up prevention unit relative to the platen roller.

According to a second aspect, provided is a label tip setting method for a linerless label in a thermal printer configured to arrange the linerless label to be nipped between a thermal head and a platen roller, feed the linerless label from an upstream side toward a downstream side along a feeding path for the linerless label, and perform printing on the linerless label. The linerless label has a label base, an adhesive layer formed on a back surface of the label base, and a thermo-sensitive coloring agent layer and a release agent layer both formed on a front surface of the label base. The platen roller is provided with a roll-up prevention unit including: a pair of left and right brackets; an upstream roll-up prevention member; and a downstream roll-up prevention member. The pair of left and right brackets is positioned at both left and right end sides of the platen roller, and at least one of the pair of left and right brackets has a roller engagement hole engaging with a roller shaft of the platen roller. The upstream roll-up prevention member and the downstream roll-up prevention member span between the pair of left and right brackets, the upstream roll-up prevention member is positioned upstream relative to the platen roller and guides the linerless label toward the thermal head and the platen roller while being in contact with the adhesive layer representing a back surface of the linerless label, and the downstream roll-up prevention member is positioned downstream relative to the platen roller and guides the linerless label away from the platen roller while being in contact with the adhesive layer representing the back surface of the linerless label. At least one of the pair of left and right brackets fixes a position of the roll-up prevention unit relative to the platen roller. The linerless label is set while being nipped between the thermal head and the platen roller in a state where a label tip portion of the linerless label is positioned over the downstream roll-up prevention member of the roll-up prevention unit.

An individual linerless label strip is issued by cutting off the linerless label with a cutting unit positioned downstream relative to the downstream roll-up prevention member. The linerless label positioned upstream relative to the individual linerless label strip is fed in reverse to the upstream side, and the reverse feeding of the linerless label can be stopped in a state where the label tip portion of the linerless label is positioned over the downstream roll-up prevention member.

At least one of the pair of left and right brackets can have a fixture hole for fixing the at least one of the pair of left and right brackets to a printer body of the thermal printer.

The roll-up prevention unit enables a printing region to be formed in a spatial region between the upstream roll-up prevention member and the downstream roll-up prevention member, and the printing region enables the linerless label to be nipped between the thermal head and the platen roller therein.

The upstream roll-up prevention member and the downstream roll-up prevention member can extend across an entire width of the linerless label at a back surface side of the linerless label.

The upstream roll-up prevention member can be composed of a plate or a shaft.

The downstream roll-up prevention member can be composed of a plate.

In the roll-up prevention device and the label tip setting method for the linerless label in the thermal printer according to the foregoing aspects, the roll-up prevention unit including the upstream roll-up prevention member and the downstream roll-up prevention member, which are respectively positioned upstream and downstream relative to the platen roller, can be fixed relative to the platen roller. Therefore, the upstream roll-up prevention member and the downstream roll-up prevention member can prevent the platen roller from rolling up the linerless label, whether the linerless label is fed by the forward or reverse rotation of the platen roller.

Especially in the roll-up prevention device for the linerless label in the thermal printer according to the first aspect, at least one of the pair of left and right brackets in the roll-up prevention unit can fix the position of the roll-up prevention unit relative to the platen roller. This makes it possible to maintain the platen roller and the roll-up prevention unit at stable setting positions, and preserve the function of stably feeding the linerless label even in a long-term operation of the thermal printer.

Especially in the label tip setting method for the linerless label in the thermal printer according to the second aspect, the linerless label is set while being nipped between the thermal head and the platen roller in a state where a label tip portion of the linerless label is positioned over the downstream roll-up prevention member of the roll-up prevention unit. This makes it possible to prevent the platen roller from rolling up the label tip portion of the linerless label from the start of the operation of the thermal printer.

DESCRIPTION OF EMBODIMENTS

The embodiments of the present invention realize a roll-up prevention device and a label tip setting method for a linerless label in a thermal printer that can secure the function of stably feeding the linerless label in forward and reverse directions without the roll-up of the linerless label by the platen roller by incorporating a roll-up prevention unit that includes an upstream roll-up prevention member and a downstream roll-up prevention member, which are respectively positioned upstream and downstream relative to a platen roller, and that can be relatively fixed to the platen roller.

Figure 1:
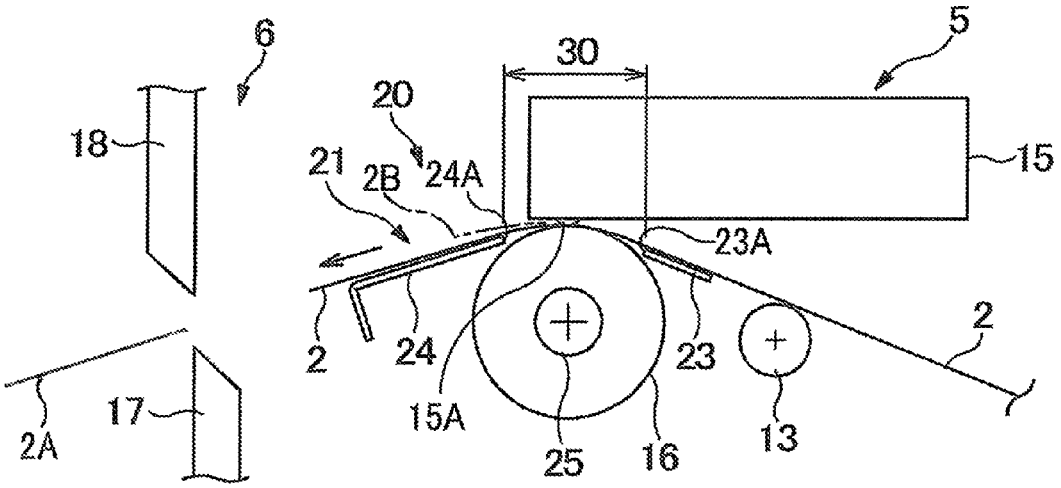
FIG. 1 is an enlarged lateral cross-sectional view of a roll-up prevention device for a linerless label in a thermal printer according to a first embodiment of the present invention.
Figure 2:
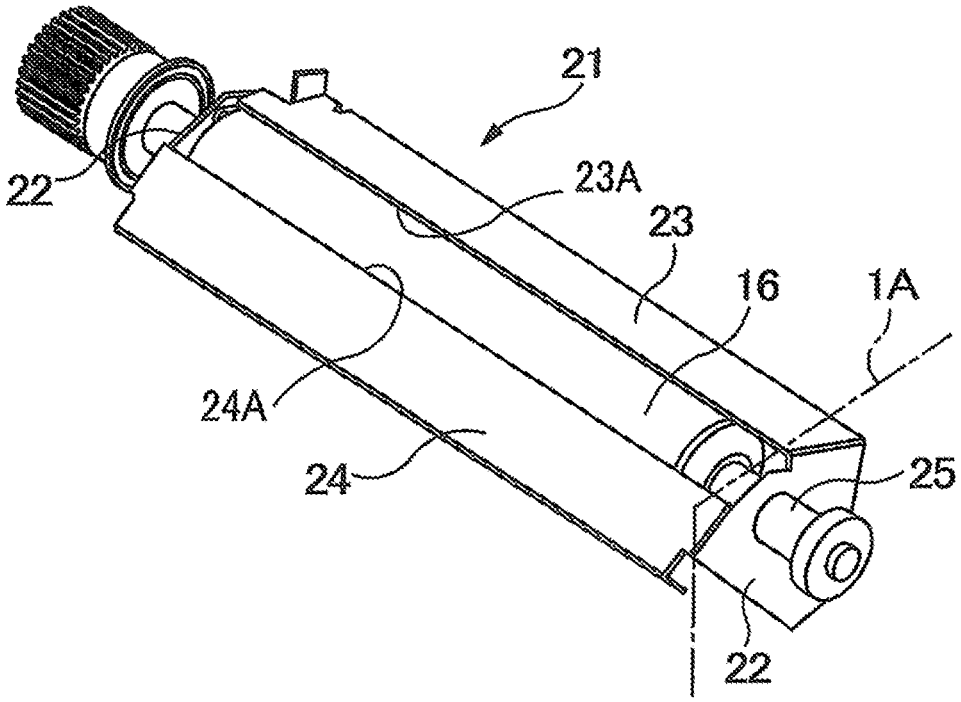
FIG. 2 is a perspective view showing the state where a roll-up prevention unit is mounted on a platen roller.
Figure 3:
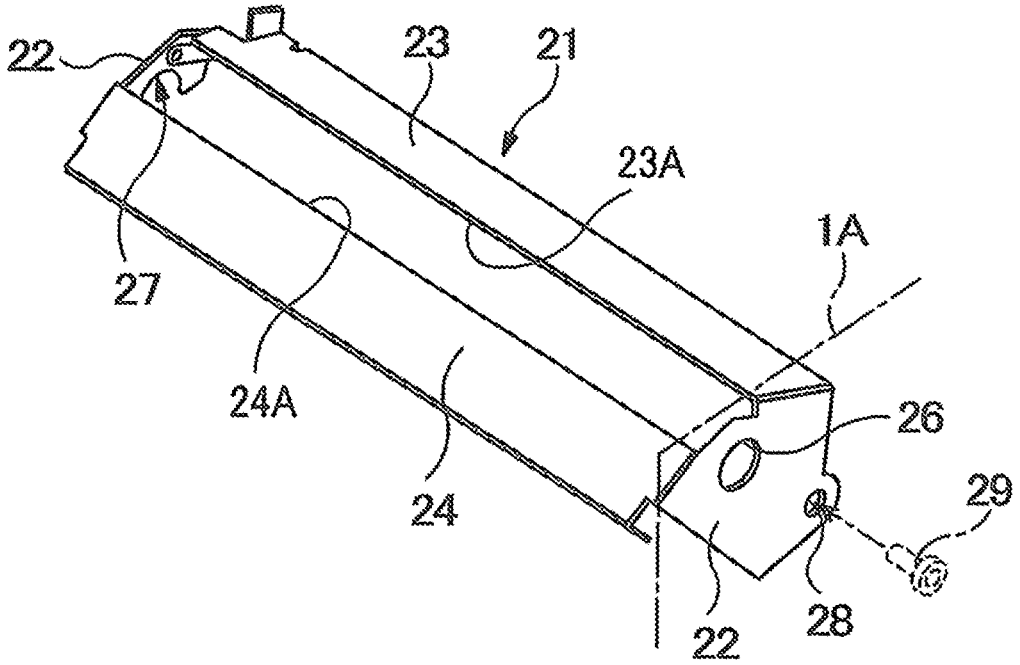
FIG. 3 is a perspective view of the roll-up prevention unit.
Figure 7:
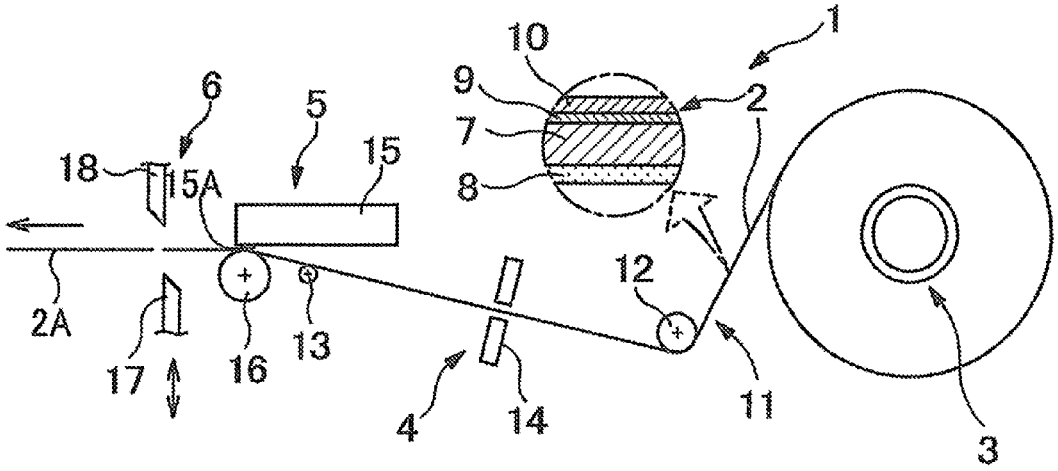
FIG. 7 is a schematic side view of a thermal printer serving as a comparative example.
Figure 8:
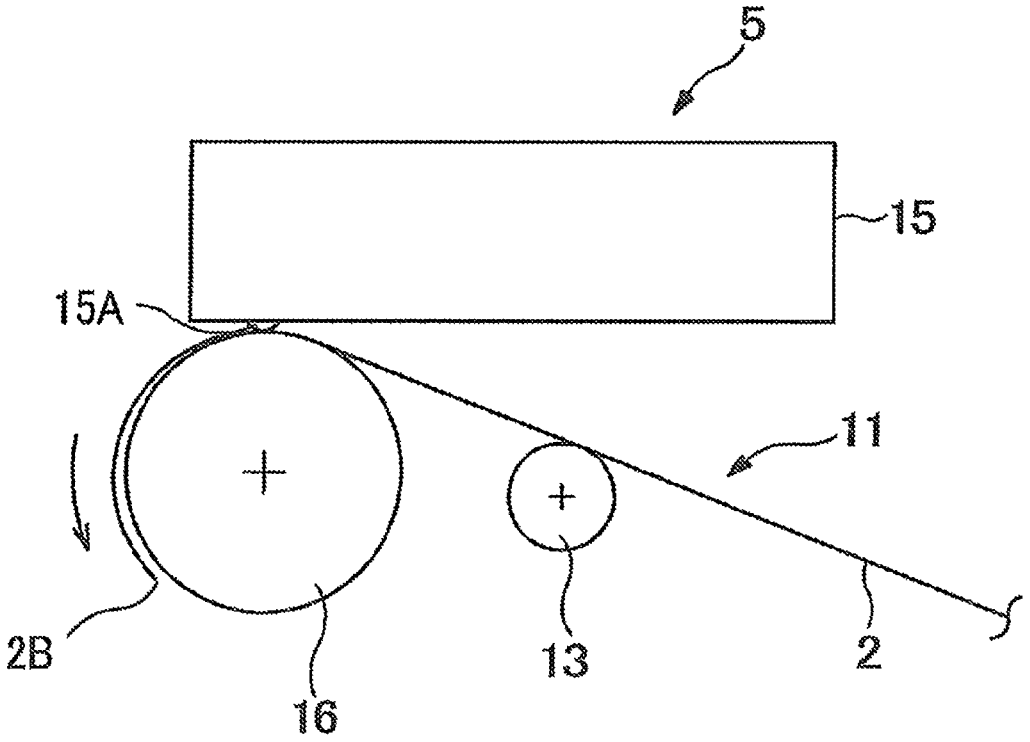
FIG. 8 is an enlarged side view showing the state where a linerless label has been rolled up by a platen roller that has been moved in a forward direction, i.e., from the upstream side to the downstream side (forward feeding).
Figure 9:
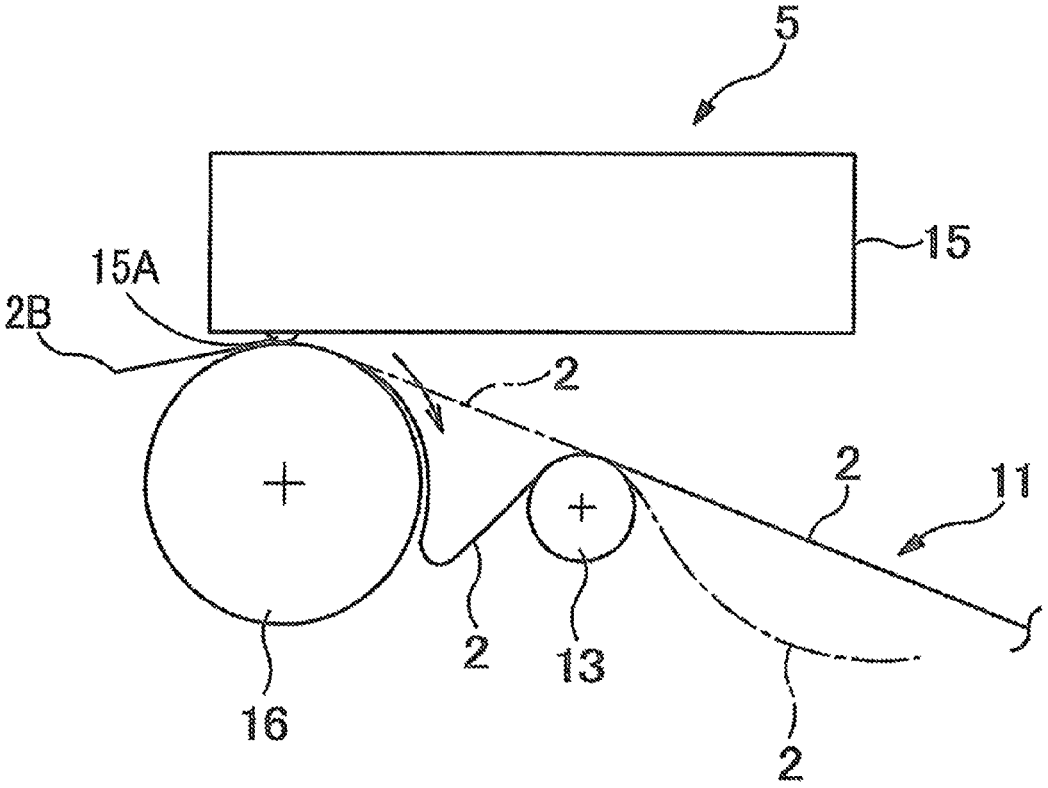
FIG. 9 is an enlarged side view showing the state where the linerless label has been rolled up by the platen roller that has been moved in a reverse direction, i.e., from the downstream side to the upstream side (reverse feeding).

With reference to FIGS. 1 to 3, the following describes a roll-up prevention device 20 and a label tip setting method for a linerless label in a thermal printer according to a first embodiment of the present invention. Note that the components that are similar to those in FIGS. 7 to 9 are given the same reference signs thereas, and a detailed description thereof will be omitted.

FIG. 1 is an enlarged lateral cross-sectional view of the roll-up prevention device 20. The roll-up prevention device 20 includes a roll-up prevention unit 21.

FIG. 2 is a perspective view showing the state where the roll-up prevention unit 21 is mounted on the platen roller 16. FIG. 3 is a perspective view of the roll-up prevention unit 21. The roll-up prevention unit 21 is composed of a pair of left and right brackets 22 positioned at both left and right end sides of the platen roller 16, and an upstream roll-up prevention member 23 and a downstream roll-up prevention member 24 that span between the brackets 22.

As shown in FIG. 3 in particular, among the pair of left and right brackets 22, one bracket has a roller engagement hole 26 that is engageable with a roller shaft 25 of the platen roller 16, and the other bracket has an arc-shaped cutout 27 that is engageable with the roller shaft 25. That is to say, as the roll-up prevention unit 21 is mounted directly on the platen roller 16, their relative positions can be maintained and their relative displacements can be minimized for a long period of time.

At least one of the pair of left and right brackets 22 (in FIG. 3, the right one) can fix the position of the roll-up prevention unit 21 relative to the platen roller 16. Specifically, at least one of the pair of left and right brackets 22 has a fixture hole 28 for fixing this bracket 22 to a printer body 1A of the thermal printer 1.

That is to say, fixing this bracket 22 to the printer body 1A by inserting, for example, a fixture screw 29 through the fixture hole 28 makes it possible to maintain the relative positions of the platen roller 16, which is also rotatably fixed to the printer body 1A, and this bracket 22 (i.e., the roll-up prevention unit 21).

The upstream roll-up prevention member 23 is composed of, for example, a metal plate, and its surface has been subjected to non-adhesive treatment, such as application of a release agent.

The upstream roll-up prevention member 23 is positioned upstream relative to the platen roller 16, and its downstream edge 23A adjacently faces the platen roller 16. The upstream roll-up prevention member 23 can guide the linerless label 2 toward the thermal head 15 and the platen roller 16 while being in contact with the adhesive layer 8 representing the back surface of the linerless label 2.

The downstream roll-up prevention member 24 is composed of, for example, a metal plate, and its surface has been subjected to non-adhesive treatment, such as application of a release agent.

The downstream roll-up prevention member 24 is positioned downstream relative to the platen roller 16, and its upstream edge 24A adjacently faces the platen roller 16. The downstream roll-up prevention member 24 can guide the linerless label 2 away from the platen roller 16 while being in contact with the adhesive layer 8 representing the back surface of the linerless label 2.

The upstream roll-up prevention member 23 and the downstream roll-up prevention member 24 extend across the entire width of the linerless label 2 at the back surface side of the linerless label 2.

Note that the upstream roll-up prevention member 23 and the downstream roll-up prevention member 24 can further obstruct the roll-up of the linerless label 2 by the platen roller 16 when their tip portions facing the platen roller 16 have an acute angle.

As shown in FIG. 1 in particular, the roll-up prevention unit 21 can form a printing region 30 in a spatial region between the downstream edge 23A of the upstream roll-up prevention member 23 and the upstream edge 24A of the downstream roll-up prevention member 24. The linerless label 2 can be nipped between the thermal head 15 and the platen roller 16 in the printing region 30. The heating element 15A of the thermal head 15 is positioned in the printing region 30. The thermal head 15, together with the outer circumferential surface of the platen roller 16, can feed and perform printing on the linerless label 2 that is nipped therebetween with a predetermined pressing force.

As shown in FIG. 1 in particular, in a normal operation of issuing an individual linerless label strip 2A with the thermal printer 1 and the roll-up prevention device 20 configured in the above-described manner, the linerless label 2 is guided by the guide roller 13 to the upstream roll-up prevention member 23 and arrives at the printing region 30, printing is performed on the linerless label 2, and then the linerless label 2 that has exited the printing region 30 is guided by the downstream roll-up prevention member 24. Consequently, the linerless label 2 can arrive at the cutting unit 6 without being rolled up by the platen roller 16.

The cutting unit 6 issues the individual linerless label strip 2A by cutting off the linerless label 2. Thereafter, in the operation of feeding the linerless label 2 in reverse to the printing start position in the printing region 30, the linerless label 2 is guided by the upstream roll-up prevention member 23 and hence is not rolled up by the platen roller 16.

The cutting unit 6, which is positioned downstream relative to the downstream roll-up prevention member 24, issues the individual linerless label strip 2A by cutting off the printed linerless label 2. The linerless label 2 positioned upstream relative to the individual linerless label strip 2A is fed in reverse to the upstream side by rotating the platen roller 16 in reverse, and the reverse feeding of the linerless label 2 is stopped in the state where the label tip portion 2B of the linerless label 2 is positioned over the downstream roll-up prevention member 24 (see a virtual line in FIG. 1).

That is to say, the linerless label 2 can be set in the printing region 30 while being nipped between the thermal head 15 and the platen roller 16 in the state where the label tip portion 2B of the linerless label 2 is positioned over the downstream roll-up prevention member 24 of the roll-up prevention unit 21.

When the thermal printer 1 has been in a printing standby state for a long period of time, at the start of the next printing, the platen roller 16 is slightly rotated in reverse to cause backward feeding of the linerless label 2, and then the label tip portion 2B of the linerless label 2 is arranged to hang over the downstream roll-up prevention member 24. This can prevent the linerless label 2 from sticking to the platen roller 16 at the start of a printing operation.

In the present embodiment, the upstream roll-up prevention member can be composed of a shaft.

Figure 4:
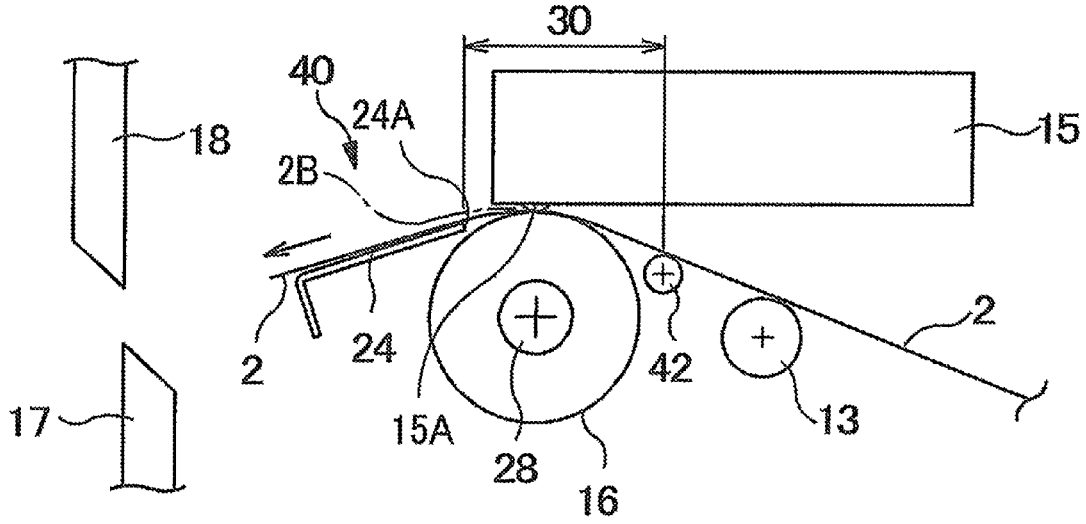
FIG. 4 is an enlarged lateral cross-sectional view of a roll-up prevention device for a linerless label in a thermal printer according to a second embodiment of the present invention.

That is to say, FIG. 4 is an enlarged lateral cross-sectional view of a roll-up prevention device 40 for a linerless label in a thermal printer according to a second embodiment of the present invention. The roll-up prevention device 40 includes a roll-up prevention unit 41.

Figure 5:
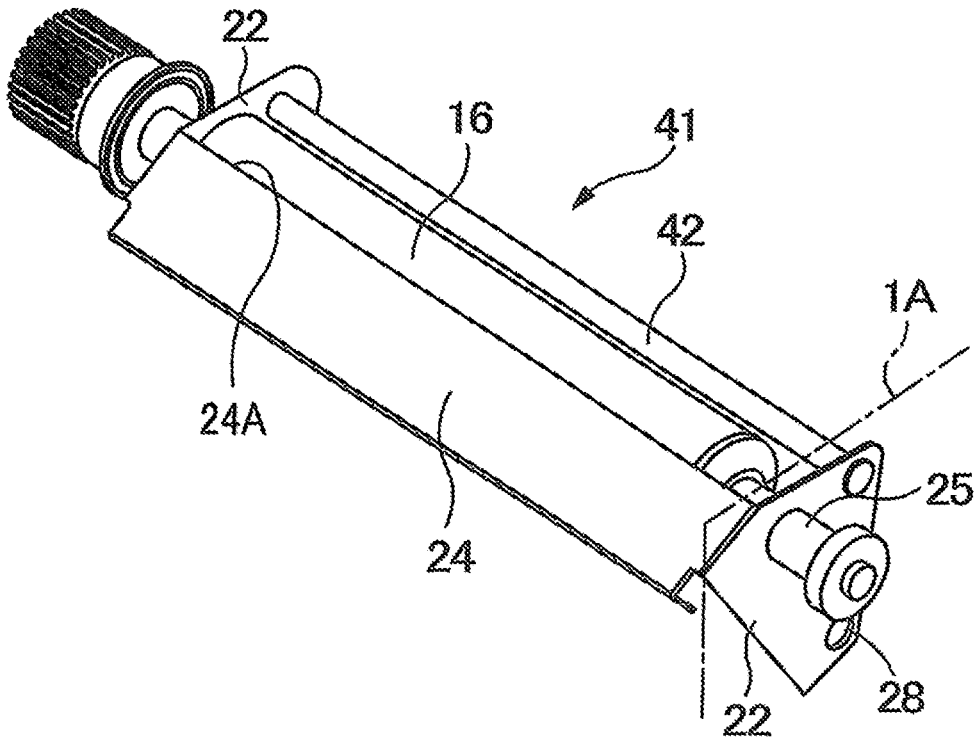
FIG. 5 is a perspective view showing the state where a roll-up prevention unit is mounted on a platen roller.
Figure 6:
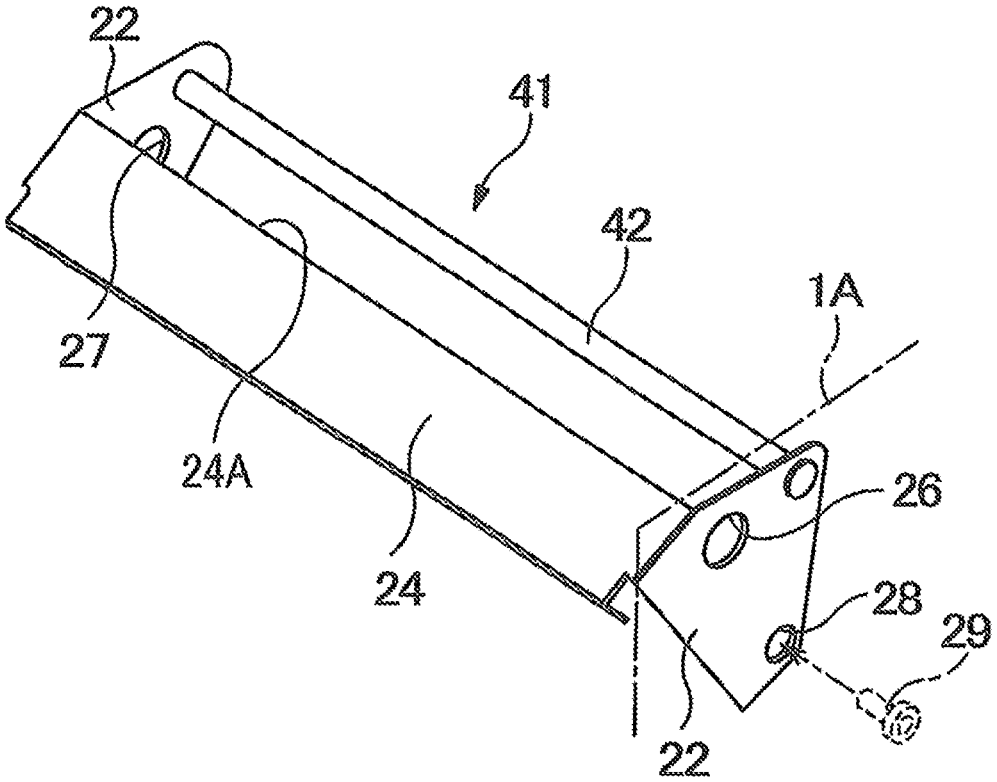
FIG. 6 is a perspective view of the roll-up prevention unit.

FIG. 5 is a perspective view showing the state where the roll-up prevention unit 41 is mounted on the platen roller 16. FIG. 6 is a perspective view of the roll-up prevention unit 41. The roll-up prevention unit 41 is composed of the aforementioned pair of left and right brackets 22 positioned at both left and right end sides of the platen roller 16, an upstream roll-up prevention member 42 that spans between the brackets 22 and is composed of a metal shaft having a circular cross-section, and the aforementioned downstream roll-up prevention member 24.

A surface of the upstream roll-up prevention member 42 has been subjected to non-adhesive treatment, such as application of a release agent. The upstream roll-up prevention member 42 is rotatable with respect to the pair of left and right brackets 22, and can smoothly guide the linerless label 2.

Except for the upstream roll-up prevention member 42 composed of the shaft, the roll-up prevention device 40 is similar to the aforementioned roll-up prevention device 20 (FIG. 1), and thus similar components are given the same reference signs.

Similarly to the roll-up prevention device 20, the roll-up prevention device 40 configured in the above-described manner can fulfill the function of stable feeding without the roll-up of the linerless label 2 by the platen roller 16 in the operation of printing on the linerless label 2 and the operation of setting the linerless label 2 at a printing position through the forward and reverse rotations of the platen roller 16.

Especially because the upstream roll-up prevention member 42 is composed of the shaft, the contact resistance between the upstream roll-up prevention member 42 and the linerless label 2 that is guided while being in contact with the upstream roll-up prevention member 42 is small, and the roll-up can be prevented in a more stable manner.

The above-described embodiments of the present invention merely represent a part of example applications of the present invention, and the specific configurations of the above-described embodiments are not intended to limit a technical scope of the present invention.

The present application claims the benefit of priority from Japanese Patent Application No. 2014-72563, filed Mar. 31, 2014 with the Japan Patent Office, the disclosure of which is incorporated herein by reference in its entirety.

The invention claimed is:

1. A roll-up prevention device for a linerless label in a thermal printer configured to arrange the linerless label to be nipped between a thermal head and a platen roller, feed the linerless label from an upstream side toward a downstream side along a feeding path for the linerless label, and perform printing on the linerless label, the linerless label having a label base, an adhesive layer formed on a back surface of the label base, and a thermo-sensitive coloring agent layer and a release agent layer both formed on a front surface of the label base, the roll-up prevention device comprising:

a roll-up prevention unit including a pair of left and right brackets, an upstream roll-up prevention member, and a downstream roll-up prevention member, the pair of left and right brackets being configured to be positioned at both left and right end sides of the platen roller, and the upstream roll-up prevention member and the downstream roll-up prevention member spanning between and being integrated with the pair of left and right brackets, wherein the upstream roll-up prevention member is configured to be positioned upstream relative to the platen roller and guide the linerless label toward the thermal head and the platen roller while being in contact with the adhesive layer representing a back surface of the linerless label, the downstream roll-up prevention member is configured to be positioned downstream relative to the platen roller and guide the linerless label away from the platen roller while being in contact with the adhesive layer representing the back surface of the linerless label, each of the pair of left and right brackets has a roller engagement hole engaging with a roller shaft of the platen roller, and at least one of the pair of left and right brackets fixes a position of the roll-up prevention unit relative to the platen roller.

2. The roll-up prevention device for the linerless label in the thermal printer according to claim 1, wherein at least one of the pair of left and right brackets has a fixture hole for fixing the at least one of the pair of left and right brackets to a printer body of the thermal printer.

3. The roll-up prevention device for the linerless label in the thermal printer according to claim 1, wherein the roll-up prevention unit forms a printing region in a spatial region between the upstream roll-up prevention member and the downstream roll-up prevention member, and in the printing region the linerless label is nipped between the thermal head and the platen roller therein.

4. The roll-up prevention device for the linerless label in the thermal printer according to claim 1, wherein the upstream roll-up prevention member and the downstream roll-up prevention member extend across an entire width of the linerless label at a back surface side of the linerless label.

5. The roll-up prevention device for the linerless label in the thermal printer according to claim 1, wherein the upstream roll-up prevention member comprises a plate or a shaft.

6. The roll-up prevention device for the linerless label in the thermal printer according to claim 1, wherein the downstream roll-up prevention member comprises a plate.

7. A label tip setting method for a linerless label in a thermal printer configured to arrange the linerless label to be nipped between a thermal head and a platen roller, feed the linerless label from an upstream side toward a downstream side along a feeding path for the linerless label, and perform printing on the linerless label, the linerless label having a label base, an adhesive layer formed on a back surface of the label base, and a thermo-sensitive coloring agent layer and a release agent layer both formed on a front surface of the label base, wherein the platen roller is provided with a roll-up prevention unit including: a pair of left and right brackets; an upstream roll-up prevention member; and a downstream roll-up prevention member, the pair of left and right brackets is positioned at both left and right end sides of the platen roller, and each of the pair of left and right brackets has a roller engagement hole engaging with a roller shaft of the platen roller, the upstream roll-up prevention member and the downstream roll-up prevention member span between and are integrated with the pair of left and right brackets, the upstream roll-up prevention member is positioned upstream relative to the platen roller and guides the linerless label toward the thermal head and the platen roller while being in contact with the adhesive layer representing a back surface of the linerless label, and the downstream roll-up prevention member is positioned downstream relative to the platen roller and guides the linerless label away from the platen roller while being in contact with the adhesive layer representing the back surface of the linerless label, and at least one of the pair of left and right brackets fixes a position of the roll-up prevention unit relative to the platen roller, and the label tip setting method comprising:

setting the linerless label while being nipped between the thermal head and the platen roller in a state where a label tip portion of the linerless label is positioned over the downstream roll-up prevention member of the roll-up prevention unit.

8. The label tip setting method for the linerless label in the thermal printer according to claim 7, comprising:

issuing an individual linerless label strip by cutting off the linerless label with a cutting unit positioned downstream relative to the downstream roll-up prevention member, and feeding the linerless label positioned upstream relative to the individual linerless label strip in reverse to the upstream side, and stopping the reverse feeding of the linerless label in a state where the label tip portion of the linerless label is positioned over the downstream roll-up prevention member.

* * * * *